US006758736B1

(12) United States Patent
Ristvedt et al.

(10) Patent No.: US 6,758,736 B1
(45) Date of Patent: Jul. 6, 2004

(54) COIN OR TOKEN SORTING APPARATUS

(76) Inventors: Victor G. Ristvedt, Box 531, Manchester, TN (US) 37349; Mark E. Ristvedt, 109 Darwin La., Oak Ridge, TN (US) 37830

( * ) Notice: Subject to any disclaimer, the term of this patent is extended or adjusted under 35 U.S.C. 154(b) by 0 days.

(21) Appl. No.: 10/170,793

(22) Filed: Jun. 12, 2002

Related U.S. Application Data

(63) Continuation-in-part of application No. 09/452,679, filed on Dec. 1, 1999, which is a continuation-in-part of application No. PCT/US98/21979, filed on Oct. 16, 1998, which is a continuation-in-part of application No. 09/141,953, filed on Aug. 28, 1998, now Pat. No. 6,017,270, which is a continuation-in-part of application No. 08/951,681, filed on Oct. 16, 1997, now abandoned.

(60) Provisional application No. 60/050,976, filed on Jun. 20, 1997.

(51) Int. Cl.[7] ..... G07D 3/04

(52) U.S. Cl. ..... 453/15; 453/5; 453/55

(58) Field of Search ..... 453/3, 5, 8, 9, 453/14, 15, 23, 55, 58; 193/DIG. 1

(56) References Cited

U.S. PATENT DOCUMENTS

| | | | | | |
|---|---|---|---|---|---|
| 512,959 | A | * | 1/1894 | Hanvey | 453/14 |
| 537,069 | A | * | 4/1895 | Reynolds | 453/14 |
| 1,433,942 | A | * | 10/1922 | Doldt | 453/14 |
| 2,487,163 | A | | 11/1949 | Miconi | 133/3 |
| 2,635,730 | A | * | 4/1953 | Sechula, Sr. | 194/303 |
| 3,125,102 | A | * | 3/1964 | Bower | 453/55 |
| 3,135,270 | A | | 6/1964 | Arnold | 133/3 |
| 3,155,101 | A | * | 11/1964 | Perkins | 453/3 |
| 3,434,482 | A | * | 3/1969 | Zimmerman | 453/9 |
| 4,286,703 | A | | 9/1981 | Schuller | 194/100 A |
| 4,385,481 | A | * | 5/1983 | Capawana | 53/461 |
| 4,878,573 | A | | 11/1989 | Kobayashi | 194/338 |
| 4,911,280 | A | | 3/1990 | Bruner | 194/338 |
| 4,995,848 | A | * | 2/1991 | Goh | 453/3 |
| 5,184,709 | A | | 2/1993 | Nishiumi | 194/318 |
| 5,346,047 | A | | 9/1994 | Ishida et al. | 194/200 |
| 5,706,927 | A | * | 1/1998 | Okitani et al. | 194/334 |

FOREIGN PATENT DOCUMENTS

| | | | | | |
|---|---|---|---|---|---|
| GB | 2.105.893 | A | * | 3/1983 | G07D/3/12 |
| JP | 4-18489 | A | * | 7/1992 | G07D/3/04 |

* cited by examiner

*Primary Examiner*—Donald P. Walsh
*Assistant Examiner*—Mark J Beauchaine
(74) *Attorney, Agent, or Firm*—Mark Clodfelter

(57) ABSTRACT

A coin or token sorting apparatus is disclosed. In this apparatus, a hopper within which coins are placed is provided with a floor, the floor also serving as a dispenser for spreading the coins out in generally across the floor. From one side of the floor the coins are provided to a plurality of V-shaped troughs being bisected longitudinally so as to create a coin path down each inner side of each trough. Coins are oriented in a single file as they move down each side of a respective trough. After being so oriented, the coins enter a region of a respective trough having a slot in a bottom thereof, with the coins riding along a narrow ridge of the slot. For each diameter of coin or token, a diverter is provided along the slot so that a coin to be sorted engages the diverter and is lifted off the ridge and directed through the slot. As such, larger coins are sorted first, with smaller coins moving unaffected past a diverter for a larger coin. After sorted coins pass through the slot, they are directed to a receptacle.

17 Claims, 15 Drawing Sheets

88
94
90
92
30

C
30
O
88
90
O
C 111
6C
112
100
110
111
106
102
6C
98
6B
94
88
92
6A
90
36
6B
30
6A
A
92
94
S2
98
104
30
90
S1
A
98
104

COIN OR TOKEN SORTING APPARATUS

CROSS REFERENCE TO RELATED APPLICATIONS

This application is a continuation-in-part of application No. Ser. 09/452,679, filed Dec. 1, 1999, which is a continuation-in-part of application number PCT/US98/21979, filed Oct. 16 1998, which is a continuation-in-part of application Ser. No. 09/141,953, filed Aug. 28, 1998 now U.S. Pat. No. 6,017,270, which is a continuation-in-part of application Ser. No. 08/951,681, filed Oct. 16, 1997 now abandoned, which claims the benefit of provisional application No. 60/050,976, filed Jun. 20, 1997.

FIELD OF THE INVENTION

This invention relates generally to high-speed sorting devices, and particularly to a coin sorter wherein mixed coins, tokens or a mixture of coins and tokens are distributed into one or more troughs each having serially arranged diverters mounted therein, at least one diverter in each trough for each diameter of coin or token to be sorted, with sorted and counted coins or tokens falling through an opening in a respective trough and passed to a collection receptacle.

BACKGROUND OF THE INVENTION

The present invention is a coin or token sorter which has its roots in a very early type of coin sorter called a "rail" sorter. In this sorter, coins or coin-like objects, such as tokens used in casinos, ride downward along a wall and on a lip or rail and are sorted either by an opening or discontinuity in the wall corresponding to the diameter of the coin to be sorted or possibly by a diverter which engages coins of the diameter to be sorted.

In accordance with this invention, there may be generally the following:

A device receives a volume of coins and spreads them into multiple channels of coin flow.

Coins then flow in a respective channel at a moderate downward angle and against a side wall surface of the channel, each side wall being with respect to a generally vertical surface so that there are two channels, and thus two flows of coins, in each trough.

The coins are separated or sorted, at the lower end of the troughs by diverters which first remove the largest coin, then the next smaller coin, then the next smaller coin, etc. Coins may be counted, typically in the area of each diverter, as they are sorted. In addition, for increased sorting speeds, the interiors of the troughs are configured to separate stacked coins.

This invention will be better understood from the following description when considered in conjunction with the appended drawings.

DETAILED DESCRIPTION OF THE DRAWINGS

Figure 1:
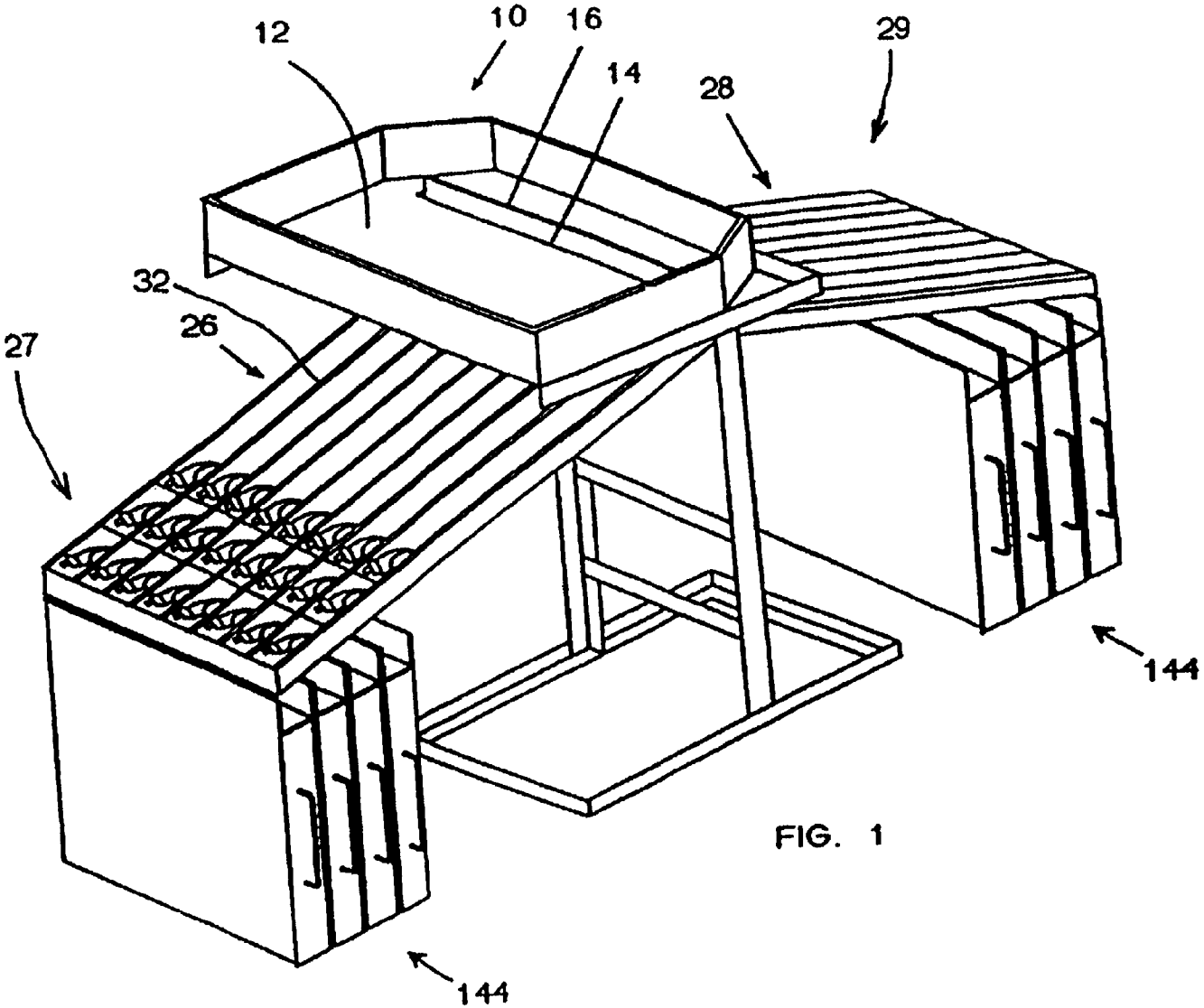
FIG. 1 is a diagrammatic illustration of one embodiment of the invention.
Figure 2:
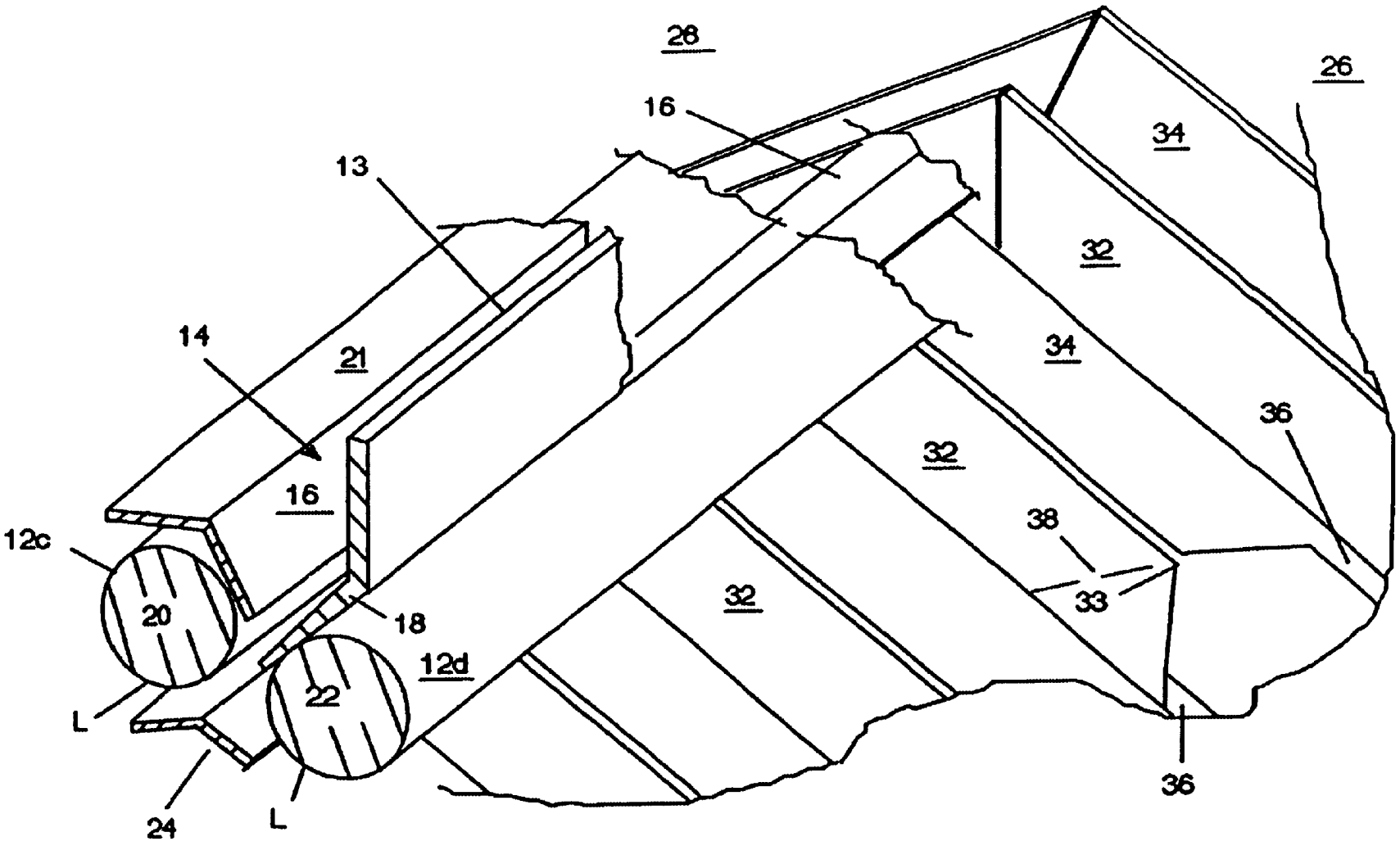
FIG. 2 as a broken diagrammatic view of one form of a coin feed portion of the sorter.
Figure 3:
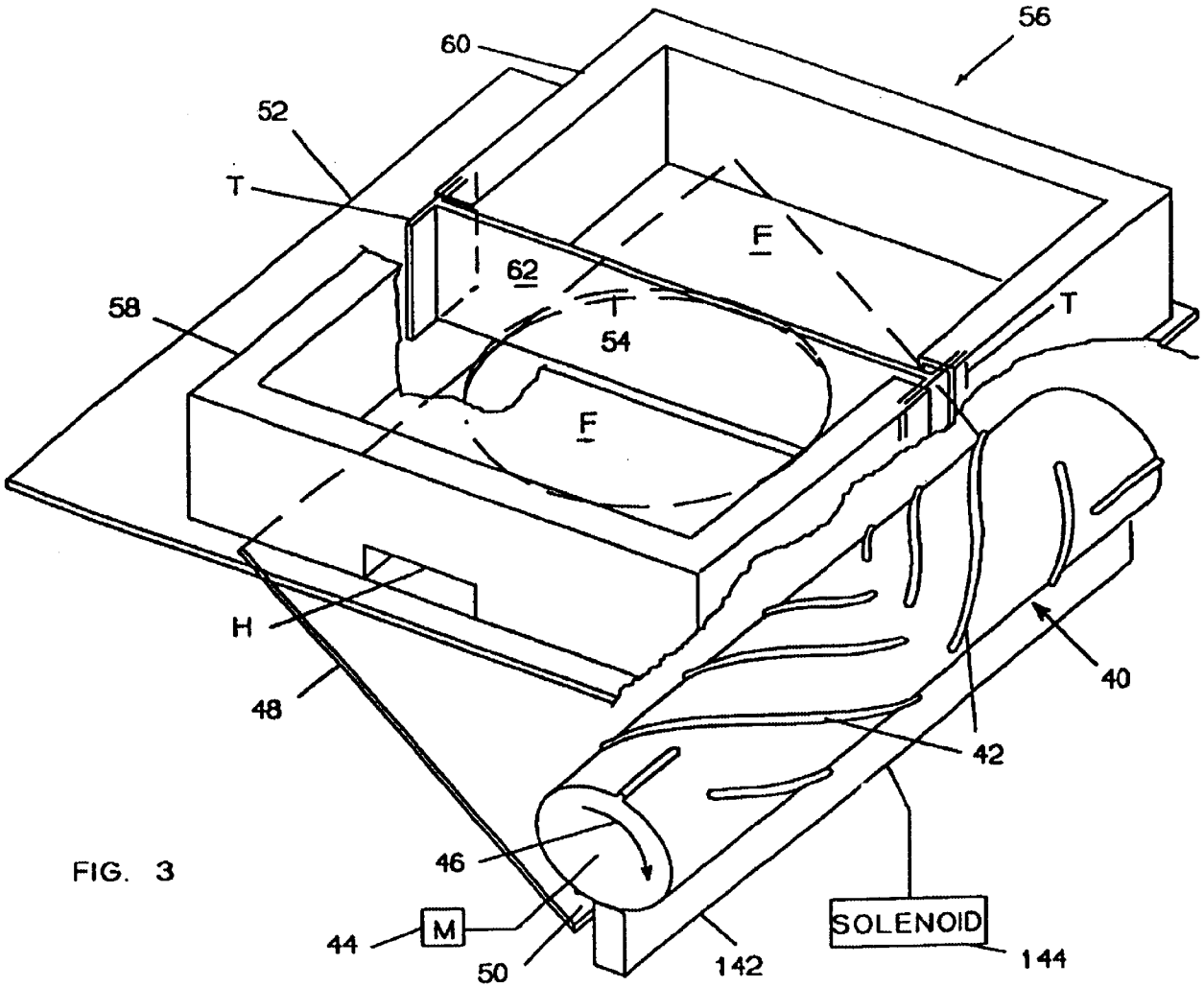
FIG. 3 is a diagrammatic illustration of a second embodiment of the invention.

Referring initially to FIG. 1, there is shown an embodiment of the invention wherein there is a hopper 10, having a floor 12. Coins or tokens are deposited on floor 12 and evenly pushed by an operator to a slot 14 through which the coins are fed to troughs 26 and 28. A baffle 16, extending upward from a far side of slot 14, may be used to prevent coins from being pushed past slot 14. By feeding coins through a slot to the troughs, the quality of coins immediately available to the troughs is limited so that the sorter does not overload. Additionally, feeding the coins through a slot assists in spreading the coins out over the full width of the sorter, which is desired for the side-by-side troughs shown in FIGS. 1 and 3. First, coins pass through a feeding structure as illustrated in FIG. 2 to troughs 26 and 28 shown in FIG. 1. Other feeding structures are illustrated in other drawings herein to feed a single set of troughs as shown in FIG. 3. It is significant that the troughs might perform an initial coin separating function as will be further described. Finally, the coins are sorted by the employment of diverters, these diverters being diverters 27 as shown in FIG. 1.

Figure 1A:
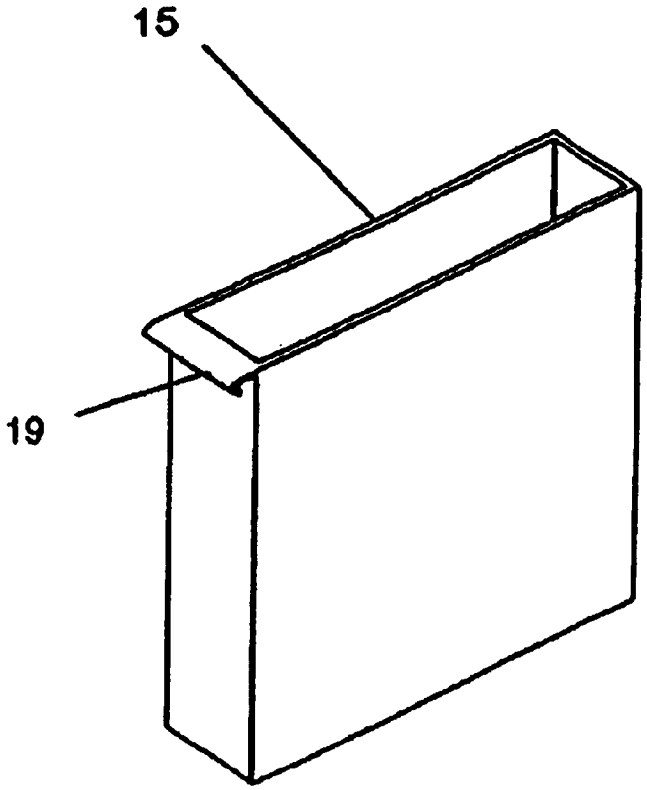
FIGS. 1*a* and 1*b* are side perspective views of coin receiving receptacles showing particular details of an aspect of the invention.
Figure 1B:
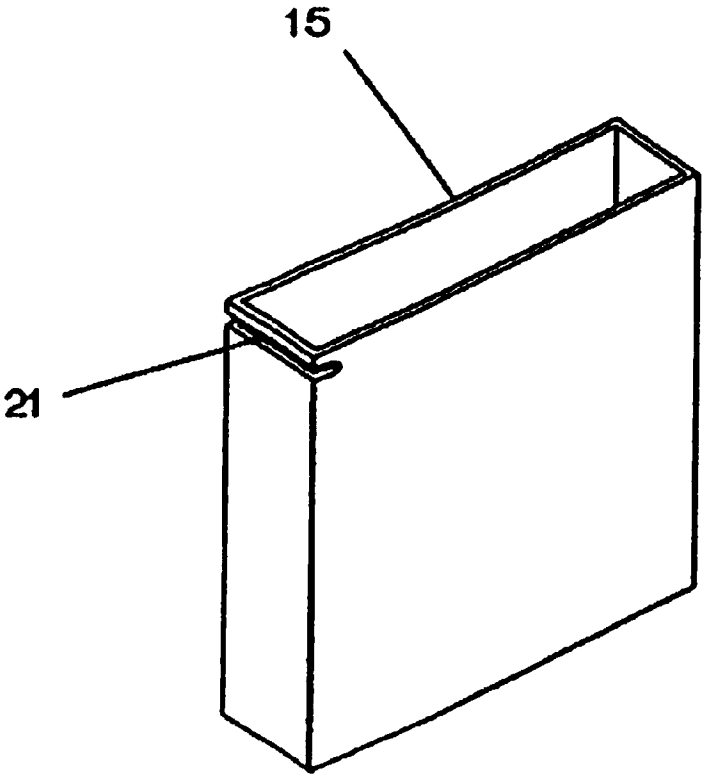
Figure 8:
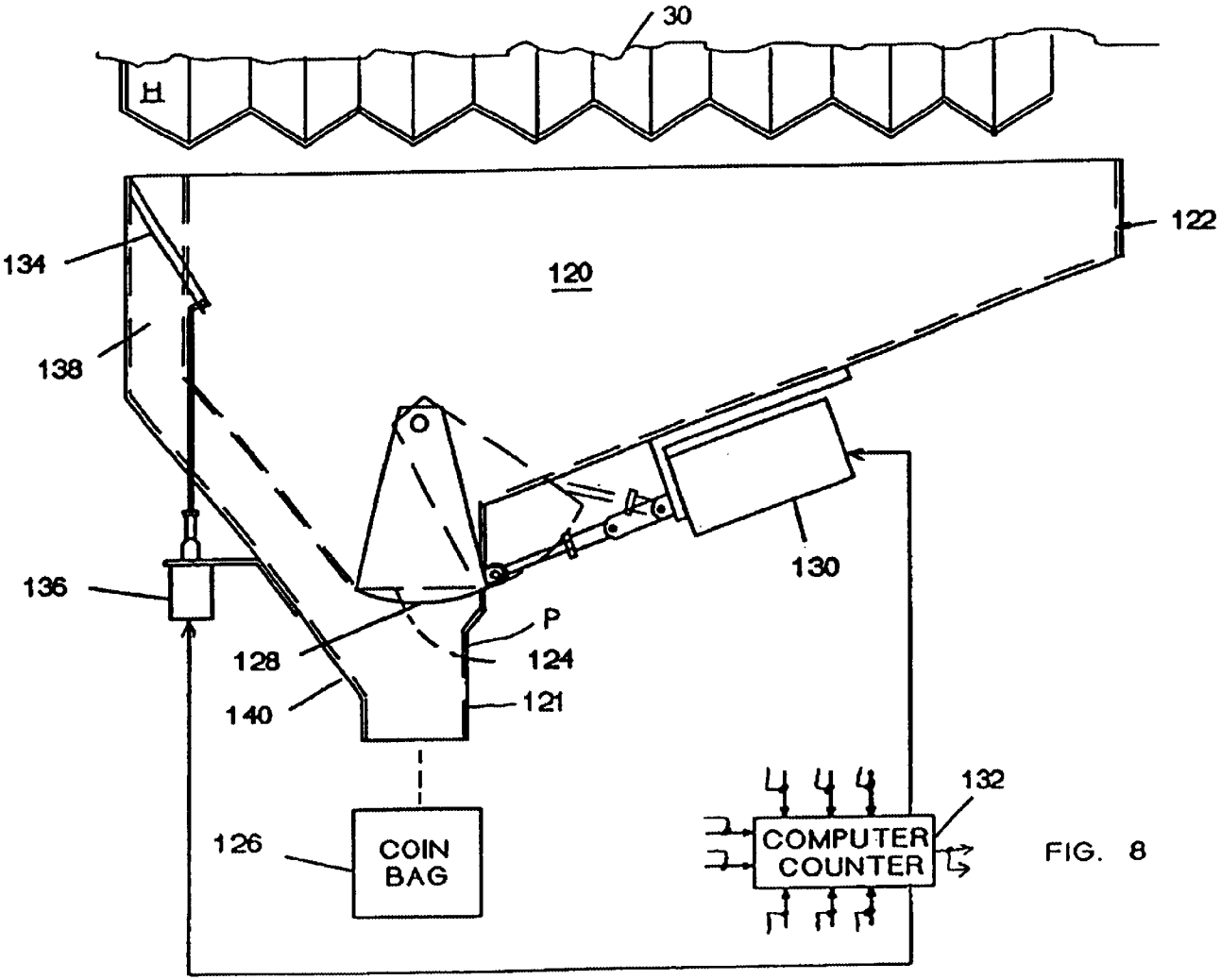
FIG. 8 is a diagrammatic view of one of four coin receiving manifolds, one for each diameter of coin.
Figures 9, 9A:
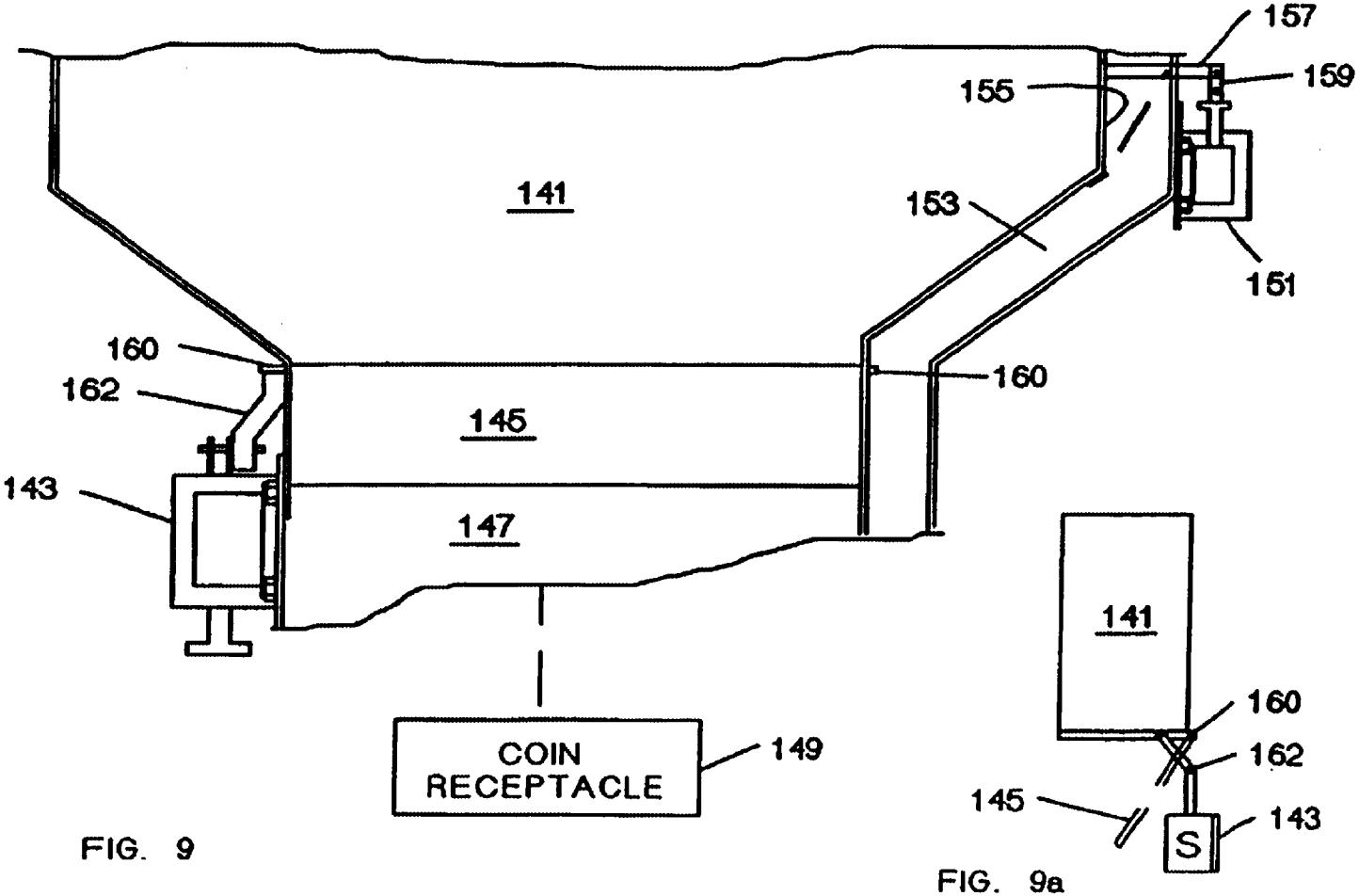
FIG. 9 is a diagrammatic view of another embodiment of the manifold construction.
FIG. 9*a* is a partial end view of the embodiment of FIG. 9 showing particular details of construction thereof.

After being sorted, the coins fall into coin manifolds and from the manifolds into bags or other containers as illustrated in FIGS. 8 and 9. Such other receptacles would include receptacle 15 as shown in FIGS. 1*a* and 1*b*, these receptacles, being conveniently removable from the sorter. Thus, as shown, receptacles 15 may basically be rectangular boxes, each having a handle 17, and further may be provided with an inner sound suppressing material. Also, rear upper edges of receptacle 15 may be provided with either a hook 19 or notch 21, as shown in FIGS. 1*a* and 1*b* respectively, for receiving an edge of a coin receptacle. Here, when emptying a coin receptacle, an upper edge of a coin bag may be held in place by a hook 19 or notch 21 and the opening of the coin bag pulled over the opening of the receptacle. The receptacle may then be emptied by simply tilting the receptacle, eliminating a need to lift a heavy coin-filled receptacle. Typically, the receptacles may be constructed of a metal or plastic material. Alternately, fabric receptacles may be employed, such fabric receptacles supported in place in the sorter by a frame.

Turning now to further details of construction, FIG. 2 illustrates an intermediate structure between hopper 10 and troughs 26 and 28 of FIG. 1. Referring additionally to this FIG., each long edge of slot 14 may be provided with downwardly extending lips 16 and 18, respectively, for funneling coins or tokens downward. Rods 20 and 22, or other similar structure, may be positioned behind and below lips 16 and 18 and serve to spread out the flow of coins between their upper side U and lower surfaces L of an inverted V-shaped plate 24. The coins would typically move in both directions (with respect to the center) along plate 24 left and right to affect an even distribution into the two sets of troughs 26 and 28 (FIG. 1). While increased or decreased numbers of troughs may be employed, four troughs along each side of the sorter allow construction of a sorter of quite convenient width and operating speed. Thus, in the described embodiment, there is created eight channels of coin flow in each set of troughs 26 and 28.

Each of the troughs is longitudinally bisected by a separator 32 (FIG. 2), extending from just under hopper 10 downward in at least an upper region of the troughs. In FIG. 2, initially the separators may be fairly thin and then transition to a wider form, leaving two, generally vertical surfaces.

Figures 6, 6A, 6B, 6C:
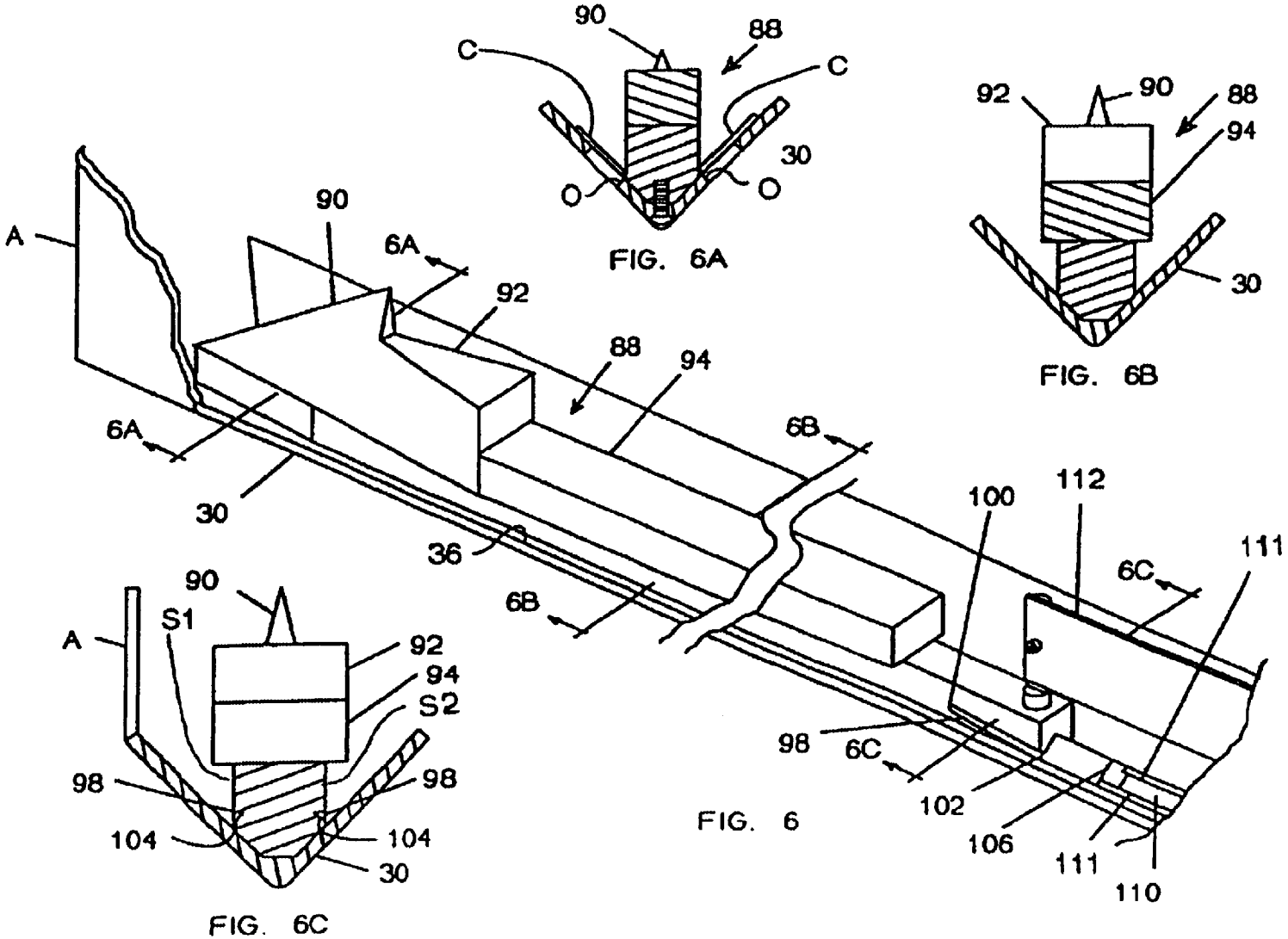
FIG. 6 illustrates a separator assembly of the present invention as manifested by a single trough or troughs shown in FIG. 1, 2, and 3.
FIGS. 6*a*, 6*b*, and 6*c* are sectional views taken along lines 6*a*, 6*b*, and 6*c* of FIG. 6, respectively.

As shown in FIG. 2, each of these troughs, hereinafter referred to as troughs 26 and 28, are longitudinally bisected by a separator 32. As stated, initially, the separators may be fairly thin and then transition at about point 33 further down the troughs to a wider dimension that generally fills the region between side walls 34 of the troughs, leaving a relatively narrow space 36 between the wider separators and side walls 34. This forces the stream of coins flowing down the troughs into generally single-file relation on each side wall 34 of the troughs. It is to be noted, however, that the separators 32 may be configured as a wedge. An alternate upper structure is shown in FIG. 6. Here, when the flow of coins encounter the transition beginning at 33, the coins are forced into generally single file conditions, although coins may still be riding one of top another in upper portions of narrow regions 36. The structure of the troughs and their function will be further discussed below.

Figure 4A:
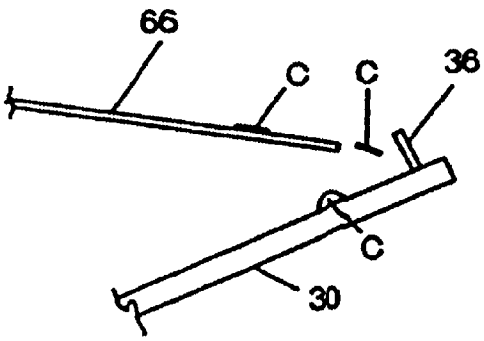
FIG. 4*a* in is a diagrammatic illustration of particulars of a coin or token feed system.
Figure 4:
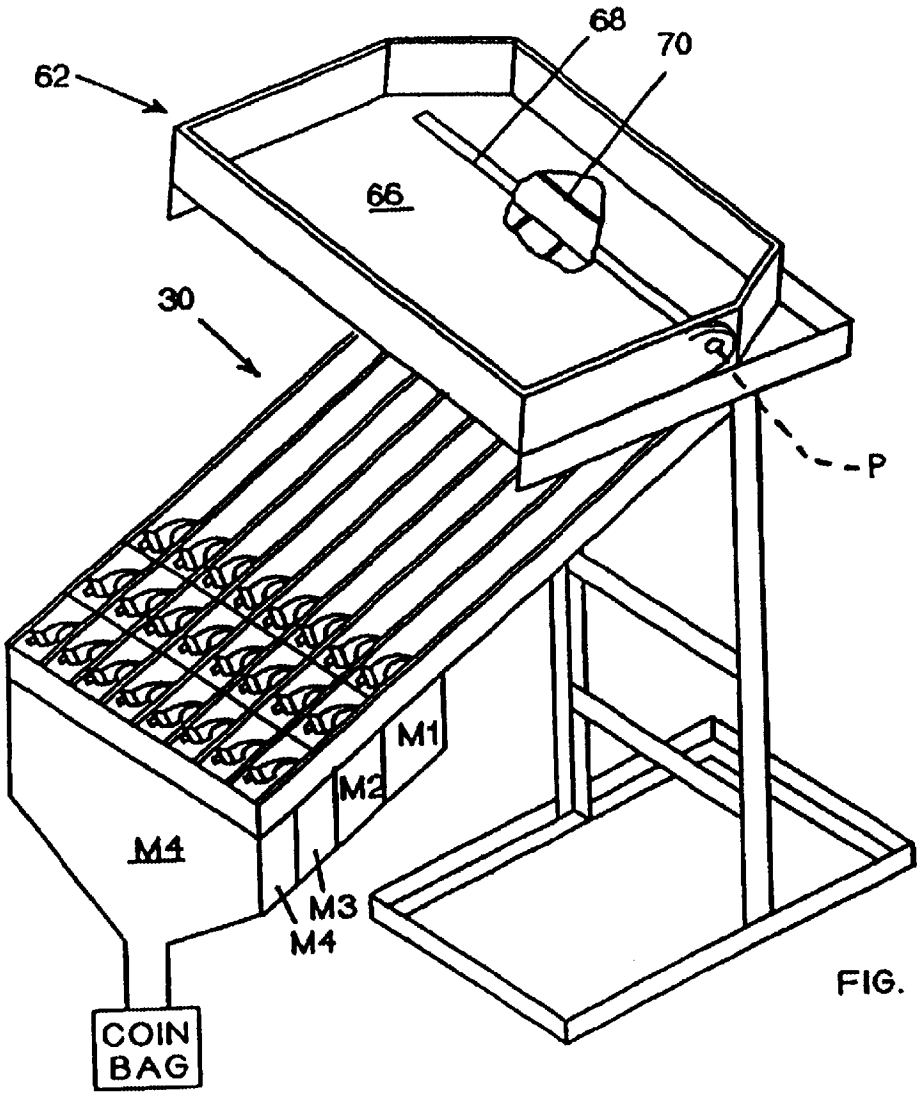
FIG. 4 is a diagrammatic illustration of another coin feed system.

At this point, the second basic embodiment of the invention, shown in FIGS. 4 and 4*a* will be examined. Differing from the sorter shown in FIG. 1, it differs principally because it has a single bank of troughs on one side of the sorter. Because of this, the configuration of a feeder will also normally differ. Referring to FIG. 4, hopper 62 may be pivoted upwardly along line P and coins resting on the base or floor 66 of hopper 62 are moved to, and fall through, slot 68, some striking baffle 70 (FIG. 4). Baffle 70 causes coins C to lose some of their forward momentum and then move downward into the troughs 30 and be a processed in the troughs to remove the top shingled or stacked coins. This latter function occurs in the troughs of both FIGS. 1 and 3.

Significantly, several coin feeders are illustrated in this application, these feeders being devices which feed coins to the troughs.

Next, a feeder illustrated in FIG. 3 will be described. Basically, a plate 48, into which coins are fed, is positioned at an angle, which may be from about 20–45 degrees or so from the horizontal, coins being moved to a forward edge of the plate at point 50. Here, and above plate 48, an elongated rolled 40 having spiral pliable ridges 42 thereon is rotated at a relatively low speed, which may be about 60 rpm or so, this rotation facilitated by a drive motor assembly 44. Significantly, roll 40 is rotated against the direction of flow of coins, as indicated by arrow 46 so that spiral ridges 42 appear to move outward along the rotating roll. Plate 48 extends generally under roll 40 and is spaced therefrom about ⅛ inch to about ¼ inch or so. Ridges or a lip may be provided along the side edges of plate 48. With this construction, a bulk quantity of coins falling on plate 48 slide downward and somewhat to the center of roll 40 and roll 40 distributes them outward, this occurring by the outward movement of ridges 42, after which the coins pass underneath roll 40 and drop into troughs of the sorter. The flow of coins may be stopped by turning off the lower drive assembly 44 and member 142 is raised by solenoid 149 under control of computer-counter 132 (FIG. 8).

FIG. 3 further illustrates structure for selectively supplying coins onto plate 48. There is employed a second plate 52 having an opening 54, through which coins are fed. A coin-holding hopper of 56, is mounted in pivotal relation with respect to plate 52 so as to dump coins through opening 54 when pivoted. Here, hopper 56 is constructed of generally hollow hopper halves 58 and 60, with ends extending over T-shaped ends T of a divider 62. Divider 62 bisects opening 54. A handhold or grip region H is provided in ends of hopper halves 58 and 60 so that each of the halves may be conveniently pivoted upward, dumping coins toward divider 62. With this construction, mixed denominations of coins or a mixture of coins and tokens may be emptied into both halves 58 and 60, after which the operator pivots one of halves 58 and 60, emptying coins therein through a respective half of opening 54. The other half of the hopper is then emptied in the same manner. Alternately, any method for applying a bulk quantity of coins onto plate 48 may be used, ideally so that they slide generally toward the center of roll 40.

Figure 5A:
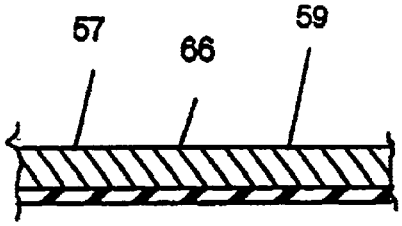
FIG. 5*a* shows details of construction of the system of FIG. 5.
Figure 5:
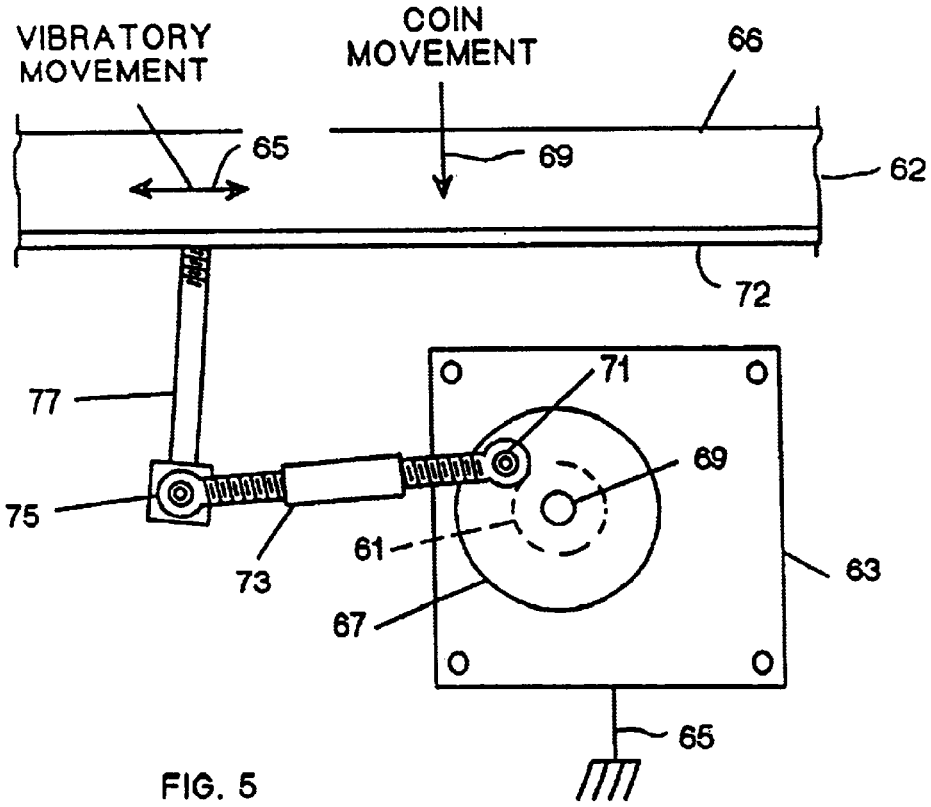
FIG. 5 illustrates still another feed system for feeding of coins to troughs.

Still another coin feeder is shown in FIGS. 5 and 5*a*. FIG. 5 shows a motor 61 mounted via plate 63 to a portion of frame 26 (FIG. 5), schematically illustrated as a structural ground or base. Motor 61 may be operated at about 200 rpm or so, producing about 200 oscillations per minute in the direction of arrow A. A wheel 67 is mounted on shaft 69 of motor 61, with an eccentric shaft 71 provided on wheel 67. A crank 73 is coupled to shaft 71 at one end, and coupled at an opposite end to a second rotary coupling 75. Coupling 75 in turn is connected to an arm 77 attached to a bottom of surface 66 of hopper 62. In this embodiment, surface 72 is tilted, as shown, at an angle of approximately 10 degrees with respect to level, tilting towards the trough. Thus, with surface 72 being oscillated in the direction of arrow A, coins flow sideways and fill the expanse of the hopper and slide downward in the direction of arrow 69 and thus through a slot along edge 72 which would affect the dropping of coins as illustrated by coin C of FIG. 3. As stated, the slope of plate or surface 66 is typically about 10 degrees.

FIG. 5*a* shows a cut-away view of surface 66 of the floor of hopper 62. Here, it is contemplated that surface 66 be constructed of a hard, slick, material which may be embossed to limit contact with the coins, and which may be an embossed glass sheet 59 on the order of about 0.25 inches thick. Coins are deposited on embossed surface 57, where, under influence of oscillations as described above, coins slide freely downward across the embossed surface to a slot at edge 72 (FIG. 5). When motor 61 is deactivated, the small angle of about 10 degrees is sufficiently small to halt downward coin movement halting flow of coins to the troughs. When motor 61 is activated, the 10 degrees angle is sufficient to facilitate coin flow in conjunction with the oscillations.

Figure 5B:
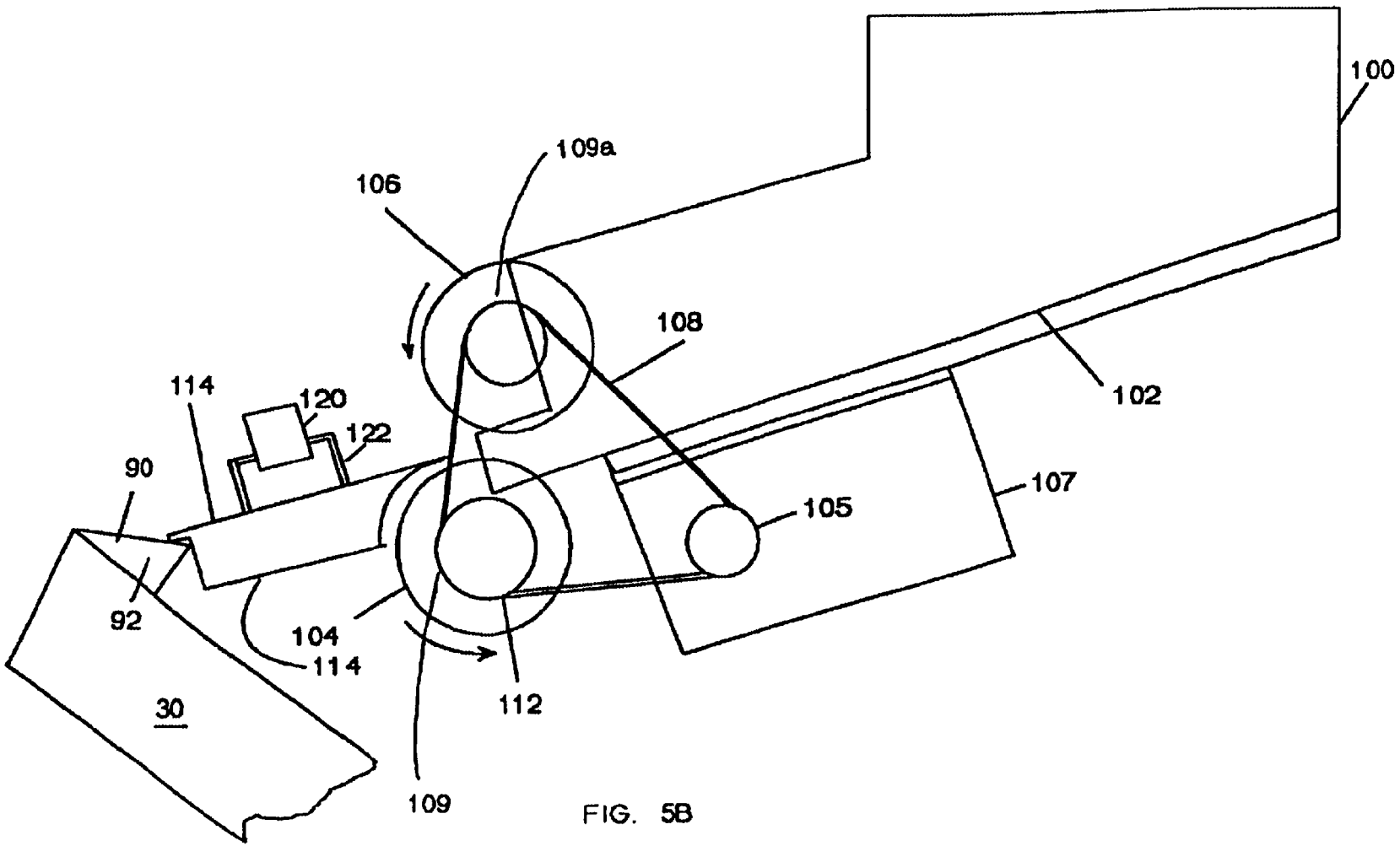
FIG. 5*b* is a diagrammatic, side illustration of yet another form of coin or no token feeder.
Figure 5C:
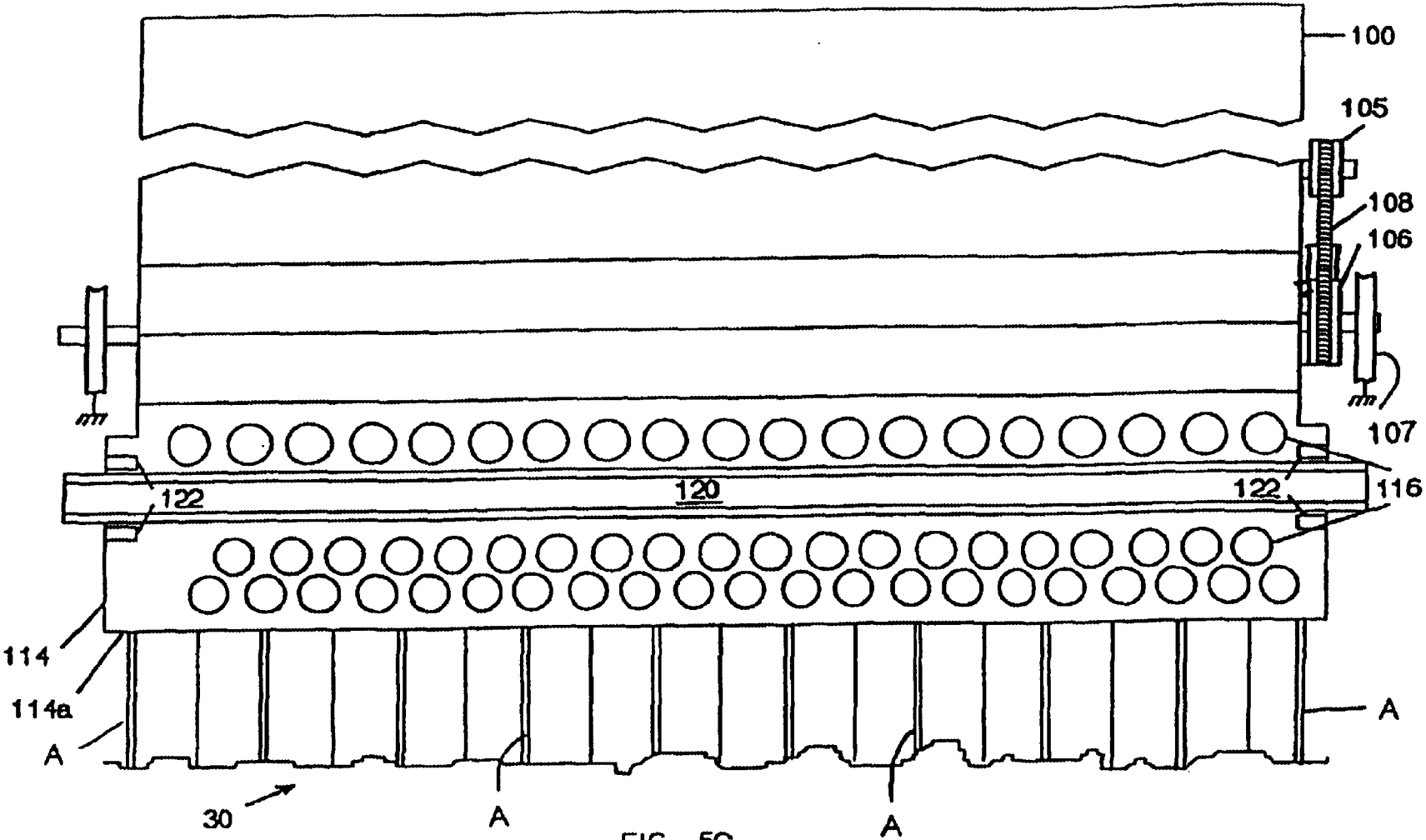
FIG. 5*c* is a diagrammatic, plan view of the structure shown in FIG. 5*b*.

FIGS. 5*b* and 5*c* illustrate yet another configuration of coin feeder. Referring FIG. 5*b*, a side view, there is shown a hopper 100 into which coins are fed, the coins resting on hopper floor 102. As we noted, it is sloped and coins move to the left, where they pass between rollers 104 and 106. Rollers 104 and 106 are driven by motor assembly 107 (not shown in FIG. 5C) via pulley 105, belt 108, and pulleys 109 and 109*a*. The top roller 106 is turned at about 100 rpm and lower roller 104 at about 50 rpm. Significantly, lower roller 104 picks up coins and drives them to the left over a top cover 114*a* of a refuse tray 114. Top cover 114*a* (FIG. 5C) has openings or holes 116 through which dirt in general and small pieces of refuse may drop into tray 114. At the same time, roller 106, which is spaced from roller 104 by about the thickness of less than twice the thickness of the largest coin be sorted, rotates oppositely to move back a coin that is riding on a lower coin. This, of course, helps to meet the object of achieving a single layer of coins. The coins then pass over refuse tray 114. Elongated bar magnet 119 extends across tray 114, being supported by a support 122. It serves to pick up magnetically attractive objects such as paper clips, etc. before they can reach a trough. Such objects may also includes some foreign coinage (foreign to the United States), which are made of ferrous material and where it is often desirable to trap such coinage, particularly where the foreign coinage of like size to American coins are worth less than their American counterpart.

Coins passing over a refuse tray 114 at an angle as illustrated in FIG. 5*b,* drop onto troughs, these troughs being 26, 28, or 30, as illustrated by FIGS. 1, 2, 3 and 6. Coins strike member 90, then 92, then reversing direction, as illustrated in FIG. 4*a* and past downward to the right.

Referring to the troughs more particularly, (FIGS. 6, 6*a*, 6*b*, and 6*c*), there is shown one example of a configuration of an upper region of the troughs 26, 28 and 30. First, the coins are laid over to the left or right by edge 90 of separator 88 and caused to move downward against one or the other of the walls of a trough, such as trough 30. Initially, a coin is directed by separator edge 90 onto one side or the other of a trough as stated. As shown in FIG. 6*a*, separator assembly 88 increases in width with downward direction, and just below upper separator portion 92 is a width so as to generally fill the central region of a trough. The sides of a trough, for example trough 30, may be about 90 degrees with respect to each other, meaning that coins travel down side walls of a trough at generally a 45 degrees angle with respect to the vertical, this for most of the distance to the diverters 27 (FIG. 1). Thus, side wall surfaces support the face of a coin and the surface of the separators supports the edge of a coin. Thus, the bottom region of each trough, including a side wall 34 and vertical surface are configured to ensure that coin travel continues with such orientation and that there is no structure to cause vertical postures of coins.

Figure 6D:
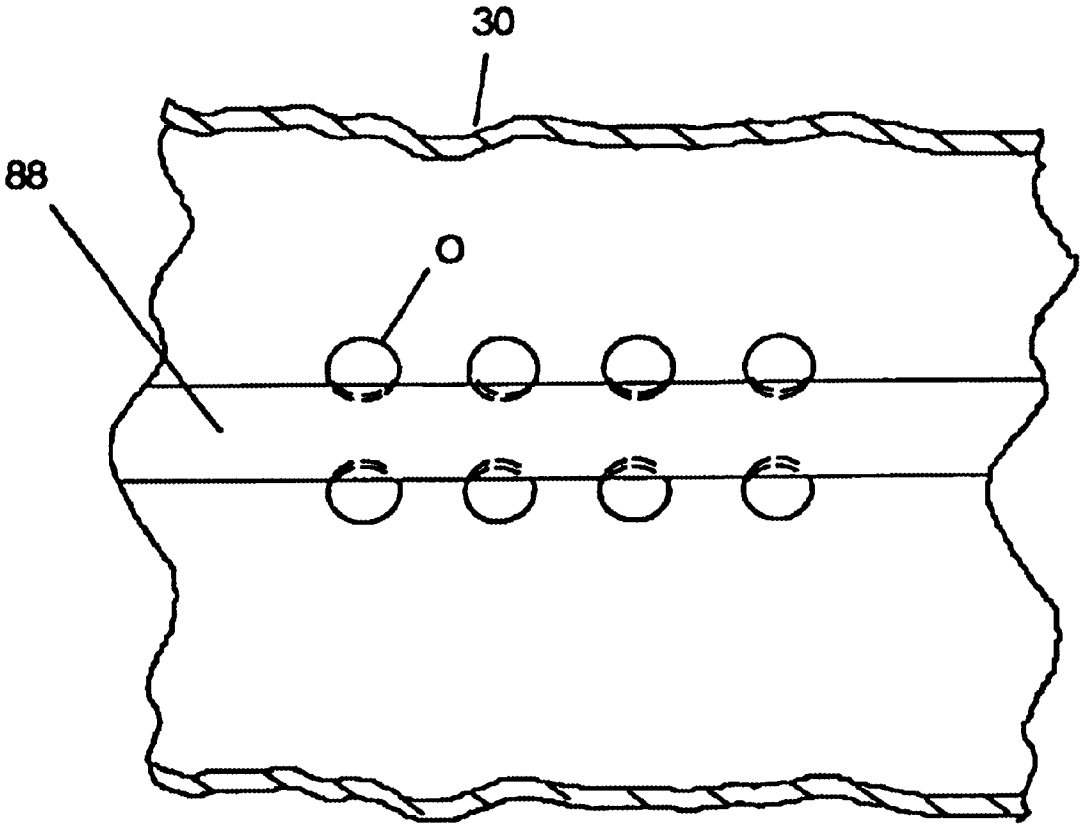
FIG. 6*d* illustrates a detail of construction of FIG. 6*a* showing arrangement of several openings employed to remove dirt.

FIGS. 6*a* and 6*d* particularly illustrate small, about in one quarter inch, diameter openings O in troughs through which dirt and other foreign matter may drop and thus present no impediment to coin flow.

The basic role of the troughs (FIGS. 6, 6*a*, 6*b*, and 6*c*) is to ensure that when coins reach a lower end portion of the troughs, where sorting occurs, that there are no stacked or shingled coins. This follows since the sorting system involves diverting of different diameter coins, and if there is a smaller coin on top of a larger coin, and sorting is controlled by the larger coin, then the smaller coin will be diverted with the larger coin and thus there will occur missorting. Examining the structure shown in FIGS. 6, 6*a*, 6*b*, and 6*c*, it is to be noted that as each coin is dropped into a given trough it is met by an edge 90 and separator surface. Thus, a coin or token entering the trough is directed to be laid over to one or the other side of the trough.

Unfortunately, as the coins past downward, invariably coins may stack one atop other. Referring particularly to FIG. 6*a*, it is to be noted that as were one coin B rests on another coin C, which is moving along the inner wall of a trough, the upper coin B is moved ahead of coin C. This occurs because the structure of a side wall being at approximately 45 degrees with respect to the vertical center member 88 invariably causes the upper coin B to move ahead of lower coin C, causing a separation of the two coins. It is believed that this is caused by a differential wedging effect on the two coins, the lower coin C having its own weight and the weight of the upper coin B, whereas the upper coin B has only its own weight. In any event, the upper coin B will move ahead of coin C and the coins will have been placed in a single layer file, a clear requirement for accurate sorting.

Further down the trough, as shown in FIG. 6*b*, an upper portion 94 of separator assembly 88 is widened, generally filling the upper portion of trough 30. This widened region further assists in forcing coins into single file relation against a surface of a side wall.

Still further down trough 30, and as shown in FIGS. 6 and 6*c*, a groove 98 is provided in a lower portion of separator assembly 88, groove 98 beginning at a point 100 (FIG. 6) elevated from sides of trough 30 and angled downward so that groove 98 a terminates at a point 102 at a respective wall of trough 30. Also at point 102, the walls S1, S2 of the lower portion of separator assembly 88 transition from being 45 degrees with respect to side wall surfaces of trough 30 to about 90 degrees with respect to trough 30. Groove 98 is then provided with a lower inner wall 104 having about a 90 degree angle with respect to an inside, adjacent wall, or surface, of trough 30. With this configuration, groove 98 aids in permitting coins from bouncing, subsequently missorting, as they encounter the transition at point 102 from a vertical wall of separator assembly 88 to a wall that is at about a 90 degree angle with respect to a sidewall surface of trough 30. The angled walls of separator assembly 88 end at point 106, where the angled separator walls meet lips or ridges 111 along which the coins continue to ride to coin sorter diverters (FIGS. 7 and 7*a*) with a slot or opening 110 positioned between lips or ridges 111. Coins fall through slot 110 as they are diverted and sorted, as will be further explained.

Figure 6E:
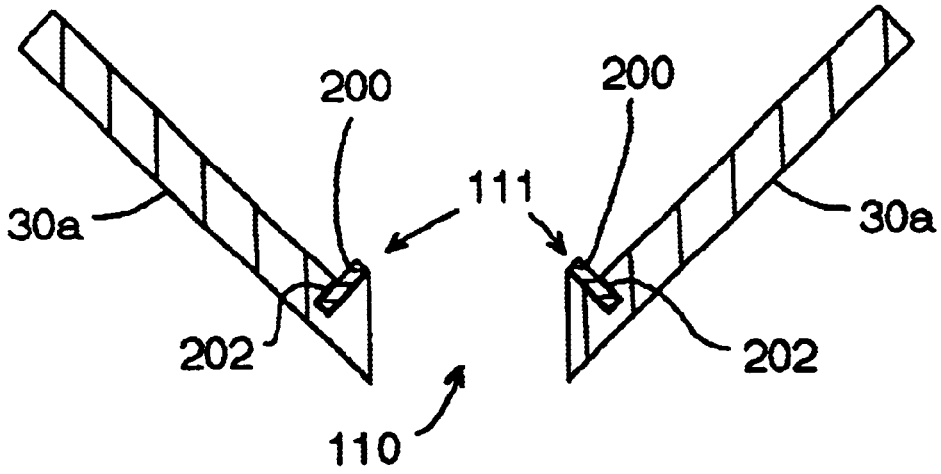
FIG. 6*e* is a sectional view of an alternate embodiment of a trough of the present invention.
Figure 6F:
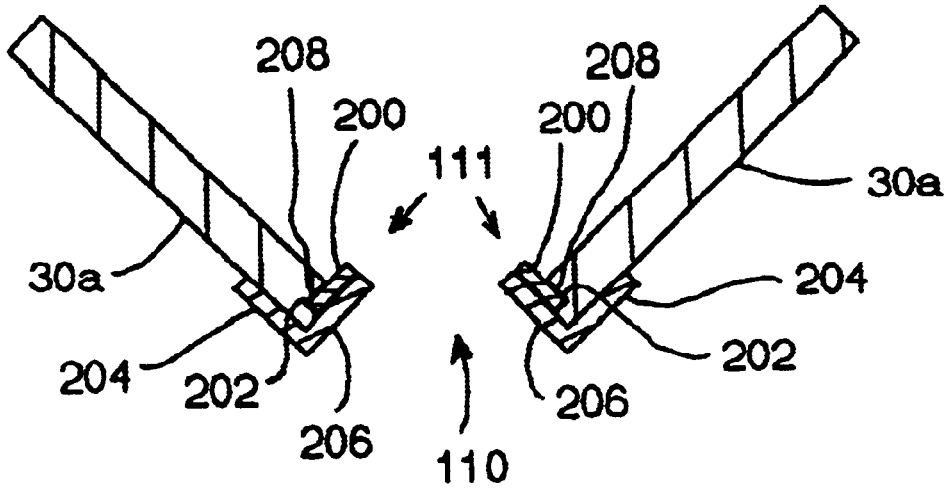
FIG. 6*f* is a sectional view of another alternate embodiment of a trough of the present invention.

In another embodiment of the troughs, and as shown in FIGS. 6*e* and 6*f*, a thin strip of material 200, such as spring steel, is positioned in a groove 202 generally normal to side walls 30*a* of the troughs. Strip 200 and the respective groove 202 is located in a respective ridge 111 beginning at point 106 (FIG. 6), and may continue along the ridge past the last diverter. In the embodiment shown in FIG. 6*e*, groove 202 is cut directly into side wall 30*a*, while in FIG. 6*f* groove 202 is formed by attachment, for example as by bolting or use of other fasteners, of an L-shaped member 204 to the underneath side of walls 30*a* so that portion 206 of member 204 forms ridge 111. Here, portion 206 is spaced from a lower edge 208 of side walls 30*a* to form groove 202. Significantly, groove 202 is slightly wider than the thickness of strip 200 so that strip 200 is generally in a loose relation with groove 202. In one particular embodiment, the groove is 0.030 inches thick and strip 200 is 0.020 inches thick. It has been found that a strip loosely fitting in a groove is particularly efficient at preventing bouncing of coins against ridge 111, which in turn enhances sorting. Strip 200 may be positioned in a groove as described for the full length of ridge 111, or may extend only partially along ridge 111 at locations where it is determined that bouncing of the coins against ridge 111 is a problem.

Also shown in FIGS. 6 and 6*c* (and in FIG. 9), a vertical wall A may extend from, and near, an upper edge of trough 30 and in at least an upper portion of each sidewall of trough 30, so that when several troughs are positioned together, each trough is enclosed along a side-by-side wall. These walls help prevent the possibility of coins jumping from one trough to another.

Figure 7A:
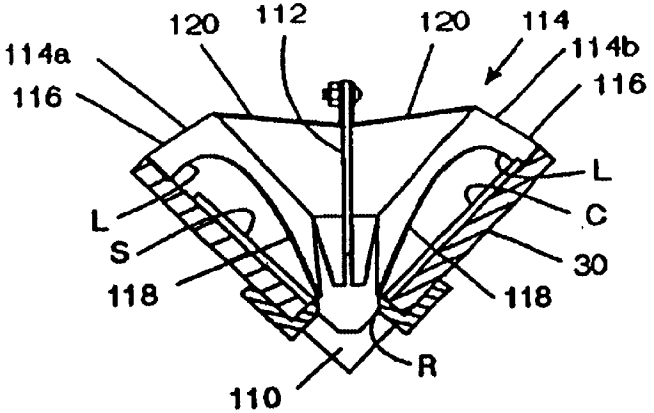
FIG. 7*a* is a sectional view being taken along lines 7*a* of FIG. 7.
Figure 7:
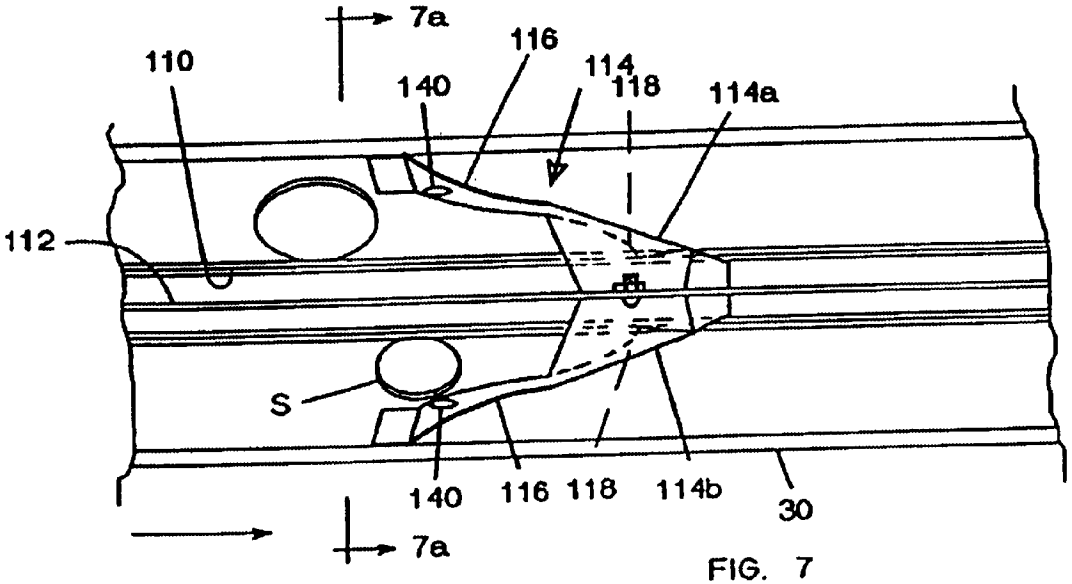
FIG. 7 is an illustration of a coin or token sorting or separating diverter.

Returning to the diverters, mounting strip 112 is supported at one end by separator assembly 88, this mounting strip supporting opposed pairs of diverters 114, one of which pairs being shown in FIGS. 7 and 7*a*. A pair of diverters 114 are mounted to mounting strip 112 for sorting each diameter of coin. An open space, such as slots 110 in the bottom of troughs 30, extend underneath the diverters generally as shown from point 106 of separator 88 (FIG. 6) to a point past the last pair of diverters where the smallest, and undiverted coins, simply fall through a slot into a holding receptacle. Alternately, instead of a slot common to all diverters for a single diameter, a discrete opening may be provided underneath each diverter for sorted coins to fall through. Slots 110, as shown in FIGS. 7 and 7*a* are configured having a ridge R along upper sides of the slot for supporting a lower edge of coins riding along walls of trough 30. Coins of a diameter to be sorted, such as coin C, and riding along ridge R initially encounter an upper inner surface 116 of a diverter, and thereafter ride along the diverter as it depends, at 118, toward slot 110. As shown, the lowest point of the diverter moves the coin off ridge R so that the coin falls through slot 110. The front of the diverter may include a deflection member so as to deflect the coin downward through slot 110. Smaller coins, such as coin S, simply pass under upper inner surface 116, and are not engaged by that diverter and continue along ridge R to the next diverter. To cause the smallest coins to fall through slot 110, ridge R may be eliminated at a point where it is desired to cause the smallest coins to fall through slot 110.

Figure 7B:
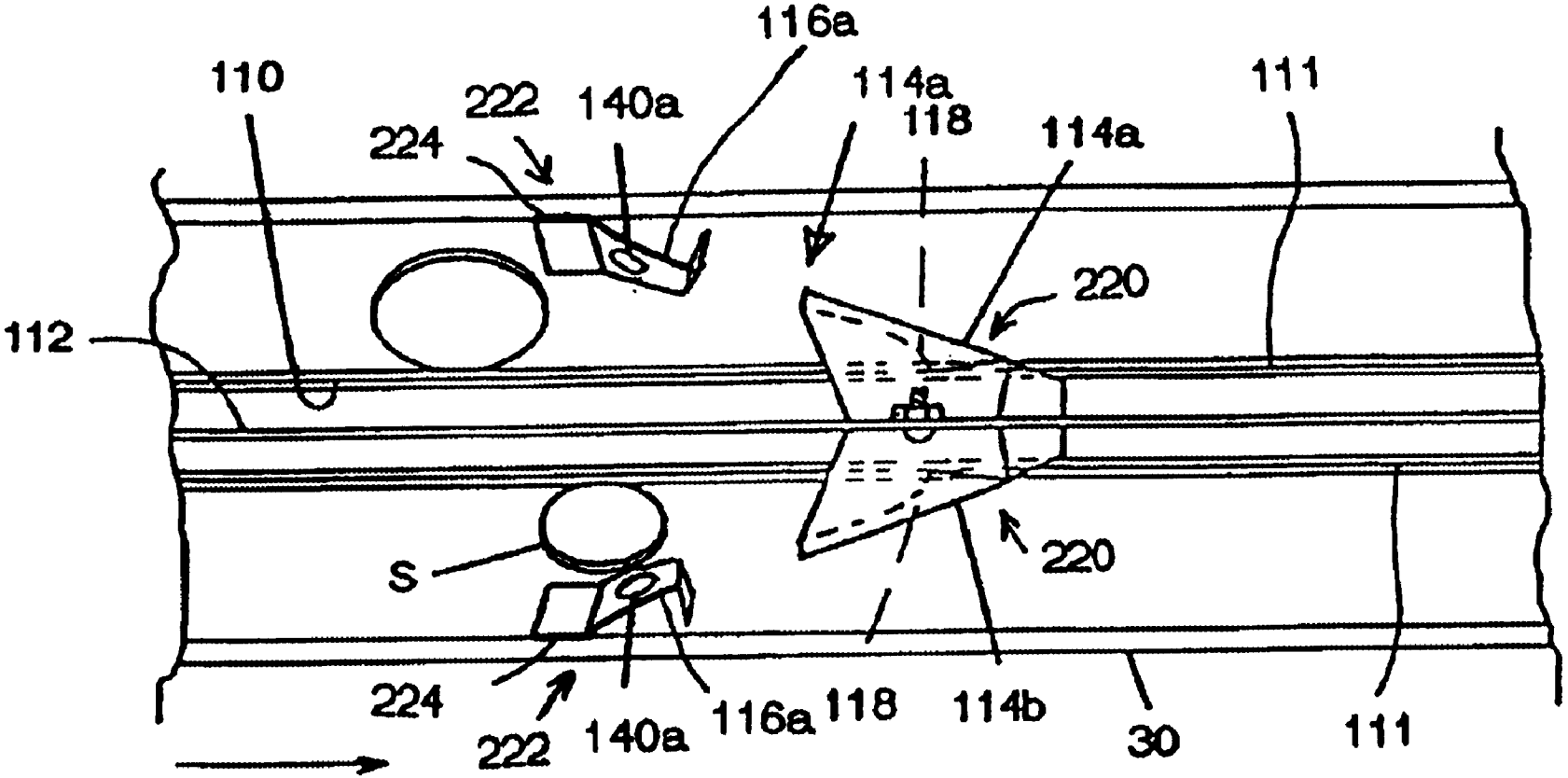
FIG. 7*b* is another embodiment of a diverter of the present invention.

In another embodiment of a diverter, FIG. 7*b* illustrates a diverter 114*a* wherein upper inner surface 116 is discontinuous, separating each diverter into two portions 220 and 222. In this embodiment of the diverters, a coin to be sorted engages portion 222 of the diverter, causing the top edge of a moving coin to be lifted off the inner surface of side wall 30. Momentum of the coin then carries the coin with its upper edge lifted away from the side wall into the diverter, where it is disengaged from ridge 111 as described and directed downward through slot 110. In this embodiment, separation of the diverter as described greatly minimizes jamming of coins at the diverter due to coins that otherwise would cause a jam being able to pass through the open region between portions 220 and 222 of the diverter. Further, by placing a thin strip of insulation 224 between portions 222 of the diverters and using a nonconductive fastener, such as a nylon fastener, to attach the diverter to the side wall of the trough, an electrically conductive contact counter 140*a* may be employed to count sorted coins.

Initially, in operation, all coins deflected through slot 110 by a diverter fall directly into the manifolds M1–M4, (FIG. 3), also designated manifolds 120 (FIG. 8). There is one manifold for each denomination of coins, and as shown, with four manifolds, there is provision for four denominations in the present example. Of course, a greater or lessor number of diameters, and thus denominations, and manifolds may be employed. Thus, other denominations may be added or subtracted by an appropriate selection of diverters.

From the manifolds, coins are ultimately supplied to a coin bag (126 in FIG. 8) or other receptacle.

As one feature of the invention, means are provided for counting coins at both a fast speed, normal operation, and at a slow speed, where it is desired to top off a container of coins at a very precise number. Accordingly, after a selected number of coins have been counted for a given diameter or denomination and have been provided to a container, additional coins for that container to bring a total count up to a precise number of coins are provided from a single diverter from a trough labeled H in FIG. 8.

FIG. 8 illustrates a manifold 120 with troughs 30 diagrammatically shown above it. FIG. 8 shows one of two arrangements for manifolds, it being for an arrangement wherein the coin bags 126, or other receptacles 23 such as shown in FIG. 4 are to be positioned across the left side of the sorter. This does require that the coin passageways P extend to the left for all coin passageways other than for manifold M4. Thus, the front of the sorter, when in use, would be the left side of the sorter shown in FIG. 4, and outlet spouts would extend to the left except for Manifold M4.

The upper region 122 of a manifold 120 is constructed to extend under the diverters for one diameter of coin of all troughs 30. Thus, all coins of one denomination are directed through slot 110 (FIGS. 7, 7*a*), into that manifold 120 (FIG. 8). Lower walls of the manifold are tapered at an angle to cause coin flow downward to ensure continuous flow. Next, coins encounter exit valve 124 which, as controlled, opens and closes an exit 128 in the manifold. Exit valve 124 is controlled by a solenoid 130, and, in turn, is controlled by computer-counter 132. Some further slope will also be incorporated in all spouts other than the spout P for manifold M4.

There is also a second gate valve 134 in turn operated by solenoid 136 and being operated under the control of computer-counter 132. Valve 134 functions to either direct coins down through an auxiliary channel 138 or into manifold 120.

Normally, and with the sorter being in a non-operating state, solenoids 130 and 136 would have been operated by computer-counter 130 to have valves 124 and 134 such that any coins from the troughs would pass through a manifold 120 and channel 138 to coin spout 124 to a coin bag 126 or other receptacle. Thus, if the sorter is started, and as an example, where the coin feeder is as shown in FIG. 3, motor 44 would be turned on, and solenoid 144 would lower coin stop 40 and coins would enter the troughs 26, 28, or 30. When the coins reach the diverters, (FIGS. 7 and 7*a*), they are sorted, and counted, this being done by conventional counters such as electrical continuity, or a contact sensor 140 (where coins bridge an insulated conductive member 140) to other metal structures of a diverter. Counts for all denomination of coins are supplied computer-counter 132 and all coins for a given denomination would flow into a coin bag 126. By this arrangement, computer-counter registers each count of a particular diameter of coin separately such that flow of a particular coin into a coin bag 126 is known by the computer-counter at all times. The object of control for the counter is to first stop the flow of coins whenever the count registered for a particular diameter of coin registers a selected amount short of the desired amount to be placed into a coin bag or receptacle. The purpose of this is so that the final filling of the bag may be done at a slower rate to enhance accuracy. Thus, for example, if it is assumed that the total amount of coins to be placed in a bag is 1000, computer-counter 132 may provide, as an example, an output signal when the count register reaches 980 or so. When this occurs, a signal is provided to solenoid 130 to close gate valve 128, blocking output flow to coin bag 126. Also, flow of coins from feeder 56 (FIG. 3) is stopped by cutting off motor 44 and operating solenoid 144 to raise 142 blocking further coin flow. Thereafter, a few coins may pass to manifold 120, but they are accounted for as being related to a new batch of coins, they being held by manifold 120. After a brief delay to ensure that any moving coins are accounted for, computer-counter 132 powers solenoid 136 to operate gate valve 134 to a vertical position wherein coins from only trough H pass down channel 138 to coin bag 126. When a precise number of coins are thus registered by the diverter(s), for example 1,000, flow is again halted and coins are directed to manifold 120 by the process described above. They are then added in computer-counter 132 to the then count for manifold 120. The operator of the sorter is sent a signal that the coin bag 126 has the prescribed number of coins and can be removed and a new coin bag be placed on or under coin exit 121.

Another embodiment of a coin-receiving manifold is shown in FIG. 9. Here, a manifold is shaped such that ultimate coin receptacles, a coin bag or other receptacle, are relatively positioned with respect to the balance of the sorter to be such as shown in FIG. 1. Here, in FIG. 9, a manifold 141 is somewhat wider than manifold 120, (FIG. 8) having the beneficial effect that coins are not required to slide as far along an inclined surface, reducing height required by the sorter. As described above, coins are sorted and fall into manifold 141. Solenoid 143 replaces solenoid 130 and it operates a gate valve 145 under which there is a transition closure 147 which is configured to supply a coin receptacle 149, corresponding, for example, to the coin receptacle 149. Another embodiment of the topping off solenoid 136 is replaced by solenoid 151 and the mechanical linkage feeding through members 159 and 157 to control a portion 155 of trickle flow channel 153. This wall portion may be constructed of flexible material such as spring steel, with a portion of the wall portion being pulled to contact the opposite side of the channel as shown in a dashed line, to effect the change in flow when solenoid 151 is appropriately actuated in the manner previously described. Alternately, portion 155 may be hinged and more conventionally operated as described with respect to FIG. 8 to achieve the functions described with respect to FIG. 8.

Turning back to valve 145, it is pivotable about pins or the like 160 with solenoid link 162 positioned as shown in FIG. 9*a*. As described above, when solenoid 143 is actuated, valve 145 swings down to about the position shown in FIG. 9*a*, allowing coins to flow into a bag or receptacle 149. Open and closed states of the valves are operated to assume the positions described for the manifold of FIG. 8 under a selected program for computer-counter 132 (FIG. 8).

The structure of the manifold assemblies may vary so long as the functions described are maintained, that is to obtain precise count of coins being supplied a bag or receptacle. Further, for example, coin sensors may be mounted on side walls of troughs for the smallest denomination of coin to be counted because there need not be a diverter for the smallest coin.

Having thus described our invention and the manner of its use, it should be apparent to one skilled in the art that further incidental modifications may be made thereto that fairly fall within the scope of the following appended claims, wherein we claim:

1. A coin or token sorting apparatus comprising:

a coin-receiving hopper at an upper end of said sorting apparatus for receiving a bulk quantity of coins, said coin-receiving hopper configured for dispensing the coins in spread-out relation, a plurality of V-shaped troughs extending downward at an angle from said coin-receiving hopper, with upper ends of said plurality of V-shaped troughs receiving said coins in said spread-out relation, a coin flow separator in each trough of said plurality of V-shaped troughs, each said coin flow separator longitudinally bisecting a respective said trough, forming a coin path along each inner side of each said trough, thus providing two discrete coin paths in each said trough, a coin sorting region in each said trough for each particular denomination of coin or token to be sorted, each said coin sorting region comprising:

a slot extending longitudinally along a bottom of each of said V-shaped troughs, a ridge along each longitudinal lower edge of each said inner side adjacent each said slot, for coins to ride on, a diverter for each diameter of coin to be sorted, each said diverter mounted generally over a respective said ridge and configured to move a said coin to be sorted off a respective said ridge and direct said coin to be sorted through said slot, after which the coin to be sorted passes into a receptacle.

2. A coin or token sorting apparatus as set forth in claim 1 wherein said coin-receiving hopper further comprises an inclined bottom plate having a lower region across which said coins are spread out by a first roller positioned just above said lower region, distributing coins in said spread-out relation into said upper ends of said plurality of V-shaped troughs, said first roller rotating in a direction opposite to that of flow of coins across said inclined plate.

3. A coin or token sorting apparatus as set forth in claim 2 wherein said first roller is configured having ridges on a surface thereof in order to assist in spreading said flow of coins into said spread-out relation across said inclined bottom plate.

4. A coin or token sorting apparatus as set forth in claim 2 further comprising a second roller positioned just below said lower edge of said bottom plate, said second roller rotated in a direction with that of said flow of coins so that said flow of coins spread out by said first roller are driven in said spread-out relation from said lower region of said inclined plate by said second roller.

5. A coin or token sorting apparatus as set forth in claim 4 further comprising a coin-receiving plate positioned just downstream from said second roller and across which said flow of coins in said spread-out relation ride to said upper ends of said plurality of V-shaped troughs, said coin-receiving plate having a plurality of openings therein for allowing passage of foreign matter therethrough, separating said foreign matter from said flow of coins.

6. A coin or token sorting apparatus as set forth in claim 5 further comprising a magnet mounted above said flow of coins across said coin-receiving plate in order to draw ferrous matter from said flow of coins as they ride across said coin-receiving plate to said upper ends of said plurality of V-shaped troughs.

7. A coin or token sorting apparatus as set forth in claim 1 wherein each said ridge further comprises a strip of hard material loosely positioned thereover so that said coins riding on said strip of hard material are prevented from bouncing, and thus missorting.

8. A coin or token sorting apparatus as set forth in claim 7 further comprising a groove formed in each said inner side adjacent each said ridge, for holding said strip of hard material.

9. A coin or token sorting apparatus as set forth in claim 8 wherein each said ridge and respective said groove are formed by attachment of an L-shaped member to each said longitudinal lower edge of each said inner side adjacent each said slot.

10. A coin or token sorting apparatus as set forth in claim 1 wherein said coin-receiving hopper further comprises an inclined bottom plate having a slick material across an upper surface thereof across which said coins are spread out in said spread-out relation.

11. A coin or token sorting apparatus as set forth in claim 10 further comprising a vibrational drive coupled to said inclined bottom plate in order to spread coins in said spread-out relation.

12. A coin or token sorting apparatus as set forth in claim 1 wherein each said inner side, preceding said coin sorting region, has at least one small opening therein for allowing foreign matter to fall from a respective said V-shaped trough.

13. A coin or token sorting apparatus as set forth in claim 1 wherein each said diverter comprises an inner portion having an edge positioned on a respective said inner side along a respective said coin path a distance from said ridge corresponding to slightly less than a diameter of coin to be sorted by that said diverter, said edge extending to said slot so that a coin of a diameter to be sorted by that said diverter is initially disengaged at a top thereof by said edge from said inner side, thereafter said coin riding along said edge of said diverter to said slot.

14. A coin or token sorting apparatus as set forth in claim 13 wherein each said diverter comprises a discrete first portion and a second portion, said first portion comprising said edge positioned on a respective said inner side, and said second portion comprising said edge extending to said slot.

15. A coin or token sorting apparatus as set forth in claim 14 wherein said first portion is electrically insulated from said inner side of said trough, with an electrical coin contact detector mounted to said first portion.

16. A coin or token sorting apparatus as set forth in claim 1 further comprising a coin manifold for receiving sorted said coins directed through a respective said slot, said coin manifold configured to control flow of sorted said coins deposited in said receptacle.

17. A coin or token sorting apparatus as set forth in claim 16 wherein said coin manifold is further configured to provide at least two controllable coin paths to a respective said receptacle, a first coin path of said two coin paths controllable to provide a majority of said coins to said receptacle and a second coin path of said two coin paths being controllable to provide a controlled, relatively small quantity of said coins to said receptacle in order to deposit said predetermined amount of said coins in said receptacle.

* * * * *